US005340328A

United States Patent [19]

Lee

[11] Patent Number: 5,340,328

[45] Date of Patent: Aug. 23, 1994

[54] PC BOARD CONNECTOR

[76] Inventor: Roger Lee, 8F-6, No. 100, Sec. 2, Hoping E. Rd., Taipei, Taiwan

[21] Appl. No.: 169,076

[22] Filed: Dec. 20, 1993

[51] Int. Cl.[5] ..... H01R 13/62

[52] U.S. Cl. ..... 439/326

[58] Field of Search ..... 439/59-62, 439/152-160, 326-329, 629-637

[56] References Cited

U.S. PATENT DOCUMENTS

| | | | |
|---|---|---|---|
| 4,898,540 | 2/1990 | Saito | 439/328 X |
| 5,094,624 | 3/1992 | Bakke et al. | 439/326 |
| 5,174,779 | 12/1992 | Chung | 439/326 |
| 5,209,675 | 5/1993 | Korsunsky | 439/326 |
| 5,232,400 | 8/1993 | Chang et al. | 439/326 |

*Primary Examiner*—Khiem Nguyen
*Attorney, Agent, or Firm*—Browdy and Neimark

[57] ABSTRACT

A printed circuit board connector including an insulative connector body having locating posts and mounting posts symmetrically disposed at two opposite ends of either PC board mounting slot thereof, and clips fastened to either clip mounting hole between the locating posts and the mounting posts through hooked joints, each locating post having a horizontal extension rod pluggable receipt into a respective locating hole on the PC board in either PC board mounting slot, each clip having a stop arm controlled by a handle portion to stop at one side of the PC board inserted in either PC board mounting slot to hold down the PC board in position.

1 Claim, 6 Drawing Sheets

PC BOARD CONNECTOR

BACKGROUND OF THE INVENTION

The present invention relates to a PC board connector adapted for use in a computer to hold at least one PC board.

Various PC board (printed circuit board) connectors have been disclosed for use in computers for mounting a variety of PC boards. These PC board connectors commonly use hook means to hook the PC boards in either PCB mounting slot. As the PC boards to be mounted vary with one another in size, the hook means cannot firmly hook all sizes of PC boards in position. Another drawback of these conventional PC board connectors is that the PC board can be conveniently dismantled once it was installed. Still another drawback of these conventional PC board connectors is that the hook means may be damaged easily during the installation of a PC board. A yet further drawback of these conventional PC board connectors is that the PC board may be scraped by the hook means easily during its installation.

SUMMARY OF THE INVENTION

The present invention has been accomplished to provide a PC board connector which eliminates the aforesaid drawbacks. It is therefore an object of the present invention to provide a PC board connector which holds down the PC board firmly after its installation. It is another object of the present invention to provide a PC board connector which is practical for mounting PC boards of length within a broader tolerance. It is still another object of the present invention to provide a PC board connector which does not damage the PC board during its installation. It is still another object of the present invention to provide a PC board connector which allows the installed PC board to be conveniently removed from the connector. According to one aspect of the present invention, the PC board connector comprises an insulative connector body having locating posts and mounting posts symmetrically disposed at two opposite ends of either PC board mounting slot thereof, and clips fastened to either clip mounting hole between the locating posts and the mounting posts through hooked joints, each locating post having a horizontal extension rod pluggable receipt into a respective locating hole on the PC board in either PC board mounting slot, each clip having a stop arm controlled by a handle portion to stop at one side of the PC board been inserted in either PC board mounting slot to hold down the PC board in position. According to another aspect of the present invention, each clip has two opposite pointed projections at two opposite lateral sides thereof and a hook on the front surface thereof in the middle for positioning in either clip mounting hole. According to still another aspect of the present invention, the stop arm can be released from the PC board by bending the handle portion outwards, and therefore the PC board can be disconnected from the horizontal extension rod of either locating post and then removed from the connector.

DETAILED DESCRIPTION OF THE PREFERRED EMBODIMENT

Figure 1:
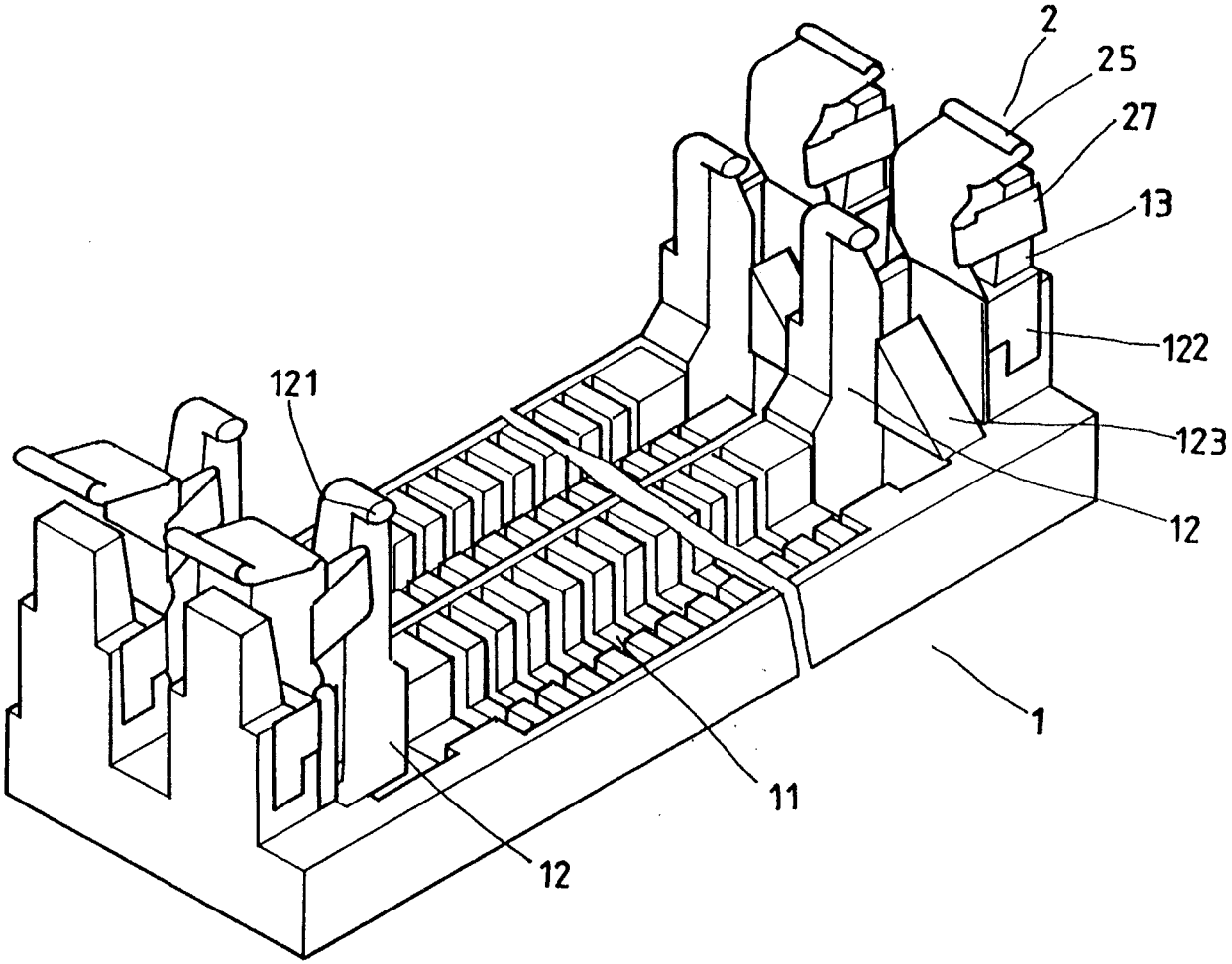
FIG. 1 is an elevational view of a PC board connector according to the preferred embodiment of the present invention.
Figure 2:
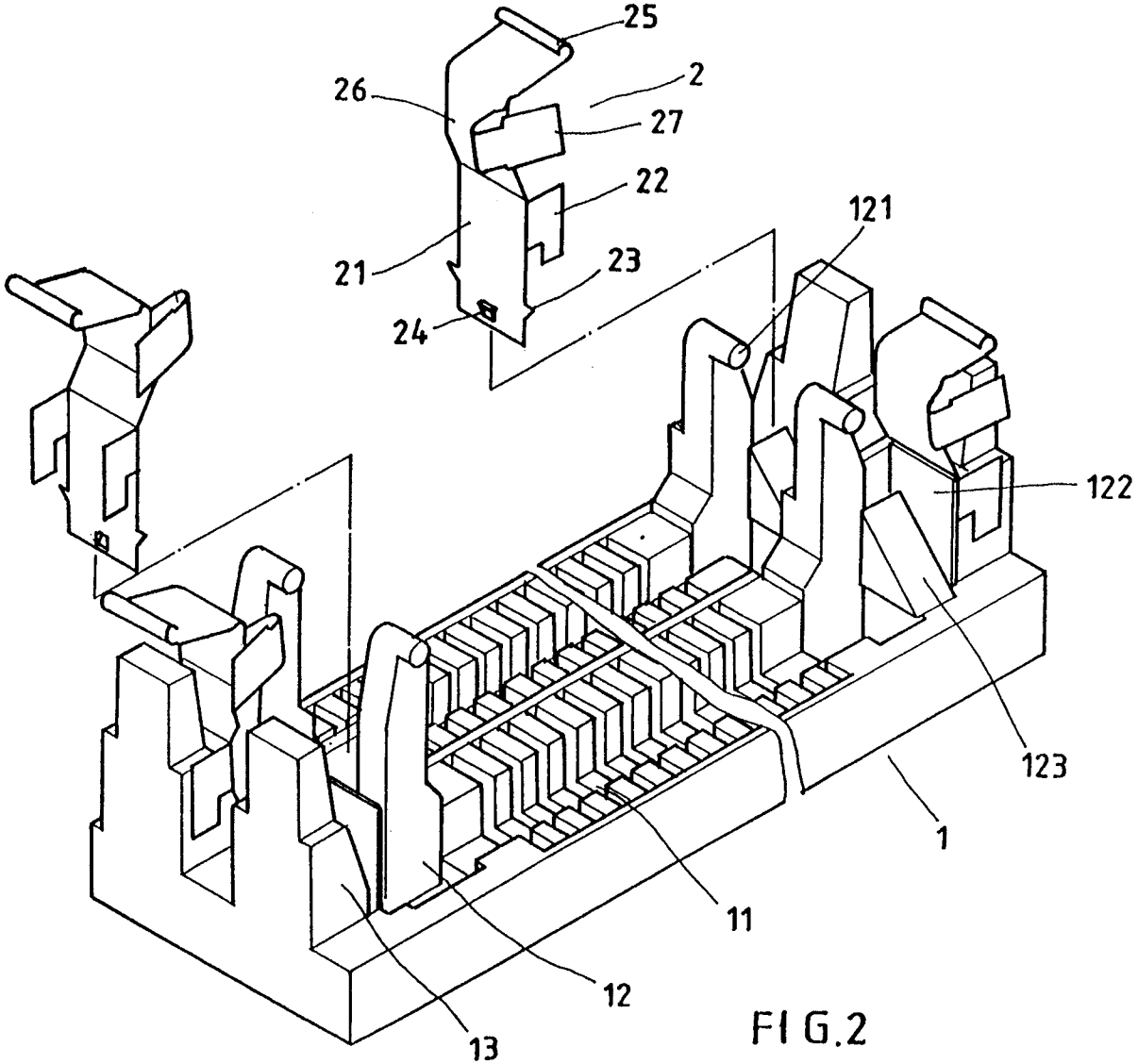
FIG. 2 is an exploded view of the PC board connector shown in FIG. 1.
Figure 3:
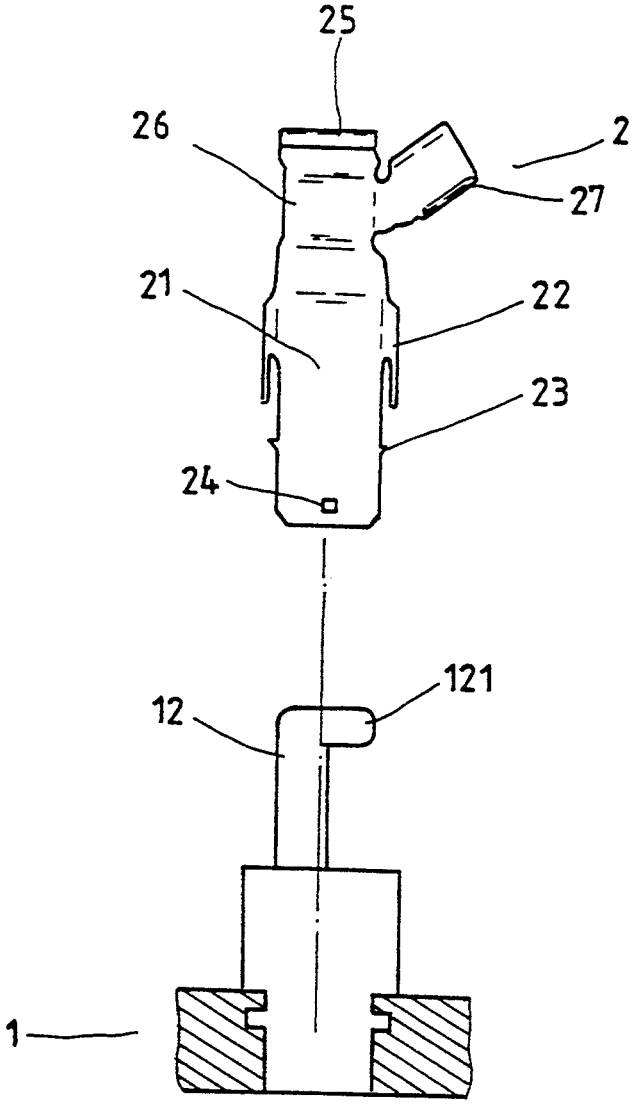
FIG. 3 is an end view taken on FIG. 2.

Referring to FIGS. 1, 2, and 3, a PC board connector in accordance with the present invention is generally comprised of an insulative connector body 1 and a plurality of clips 2.

The insulative connector body 1 comprises two pairs of mounting posts 13 at two opposite ends, two pairs of locating posts 12 spaced at two opposite ends between the mounting posts 13, two longitudinal PCB mounting slots 11 between the locating posts 12, two triangular blocks 123 at one end of either PCB mounting slot 11, and two pairs of angle plates 122 respectively extended from either locating post 12 and disposed between the locating posts 12 and the mounting posts 13. The design of the triangular blocks 123 prohibits reverse installation of PC boards. Each locating posts 12 comprises a horizontal extension rod 121 at the top for pluggable receipt into a respective locating hole on the respective PC board being mounted in either PCB mounting slot 11.

The clips 2 are respectively fastened to the mounting posts 13 to hold PC boards in the PCB mounting slots 11. Each clip 2 comprises a flat mounting portion 21, a handle portion 25 at the top, a curved spring portion 26 connected between the flat mounting portion 21 and the handle portion 25, a unitary stop arm 27 extended forwards from one lateral side of the curved spring portion 26, two opposite pointed projections 23 bilaterally extended from two opposite lateral sides of the flat mounting portion 21 at a lower elevation, a hook 24 raised from a front surface of the flat mounting portion 21 and disposed between the pointed projections 23, and two backward clamping arms 22 bilaterally extended backwards from the two opposite lateral sides of the flat mounting portion 21 at right angles and spaced above the pointed projections 23.

Figure 4:
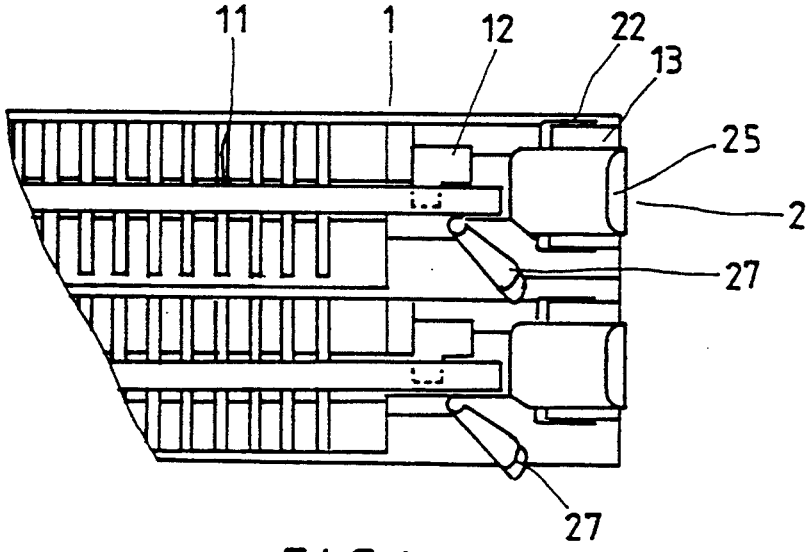
FIG. 4 is a top view of the PC board connector shown in FIG. 1.
Figure 5:
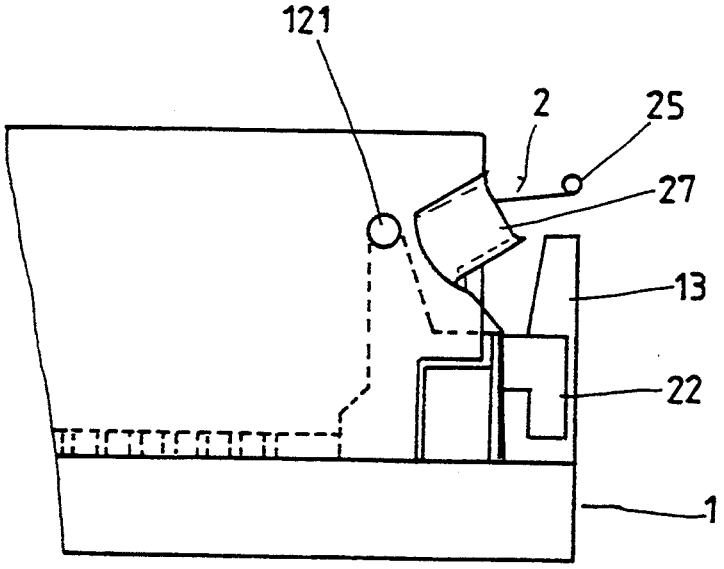
FIG. 5 is a side plain view taken on FIG. 4.

Referring to FIGS. 4 and 5, the flat mounting portion 21 of the clip 2 is inserted through the space between either angle plate 122 and the respective mounting post 13 into a respective mounting hole (not shown) on the insulative connector body 1 for permitting the pointed projections 23 to hook in the mounting hole at two opposite sides. When installed, the hook 24 hooks on the angle plate 122 at the bottom, and the clamping arms 22 clamp on two opposite sides of the respective mounting post 13. When inserting a PC board into either PCB mounting slot 11, the handle portion 25 of the clip 2 at either end of the PCB mounting slot 11 is respectively and slightly pulled outwards for permitting the PC board to be plugged into the respective PCB mounting slot 11. When inserted, the horizontal extension rod 121 of either locating post 12 fits into the respective locating hole on the PC board. As the handle portion 25 is released from the hand, the stop arm 27 of the clip 2 immediately stops at one side of the PC board back, and therefore the PC board is supported between the curved spring portions 26 of the two clips 2 at the two opposite ends of the respective PCB mounting slot 11 and retained to the horizontal extension rods 121 of the two locating posts 12 at the two opposite ends of the same PCB mounting slot 11.

Figure 6:
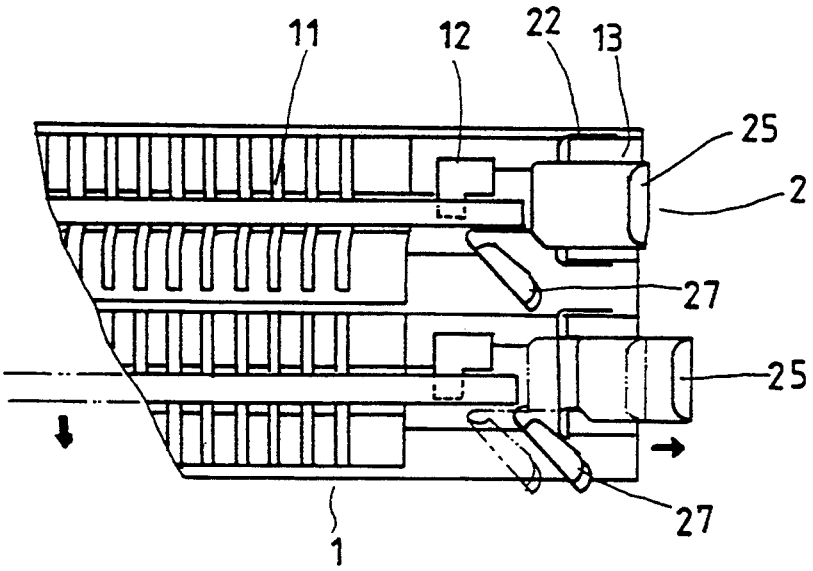
FIG. 6 is similar to FIG. 4 but showing the direction to remove the clips from the connector body.
Figure 7:
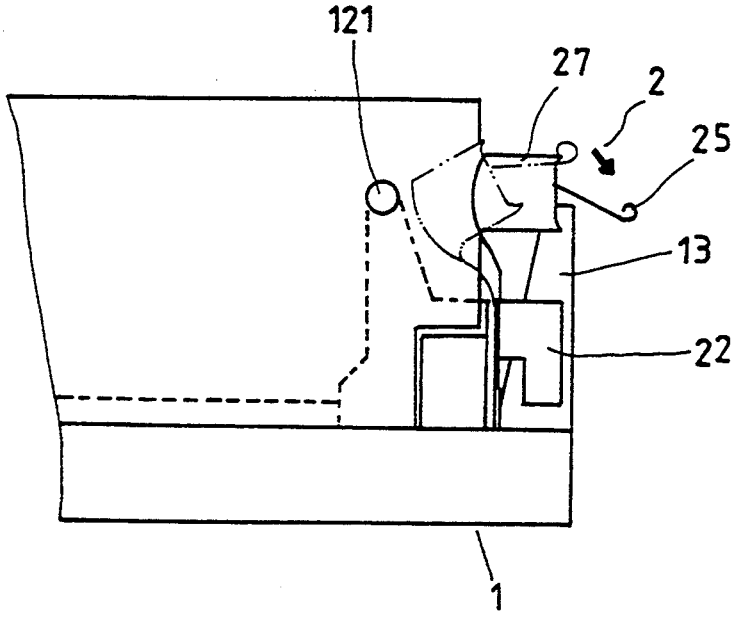
FIG. 7 is a side plain view taken on FIG. 6.
Figure 8:
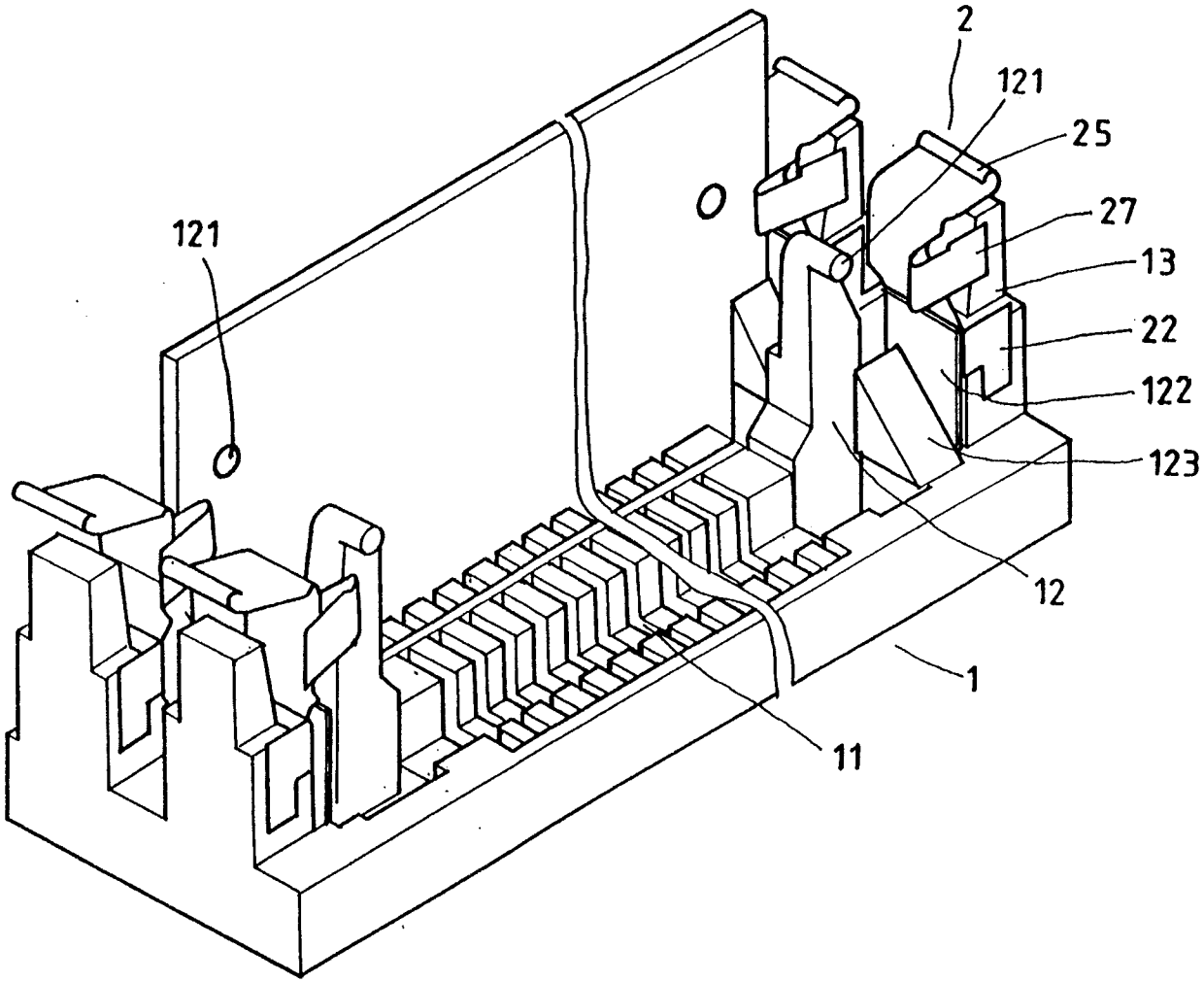
FIG. 8 shows a PC board installed in the PC board connector of FIG. 1.

Referring to FIGS. 6 and 7, when the handle portions 25 of the two clips 1 at two opposite ends of either PCB mounting slot 11 are respectively pulled backward to release the respective stop arms 27 from the PC board, the PC board can be tilted sideways to disconnect from the horizontal extension rods 121 of the respective locating posts 12 and then removed from the respective PCB mounting slot 11.

What is claimed is:

1. A printed circuit board connector comprising:

an insulative connector body which comprises at least one longitudinal printed circuit board mounting slot, at least one pair of mounting posts respectively disposed at two opposite ends of said printed circuit board mounting slot, at least one pair of locating posts respectively disposed between said at least one longitudinal printed circuit board mounting slot and said at least one pair of mounting posts, at least one triangular block respectively disposed at one side of either locating post at one end of either longitudinal printed circuit board mounting slot, at least one pair of angle plates respectively extended from either locating post at one end of said printed circuit board mounting slot, and a plurality of clip mounting holes respectively disposed between said at least one pair of locating posts and said at least one pair of mounting posts, said at least one pair of locating posts having each a horizontal extension rod at the top for pluggable receipt into a respective locating hole on a printed circuit board being mounted in said at least one longitudinal printed circuit board mounting slot; and at least one pair of clips respectively fastened to said clip mounting holes to hold down each printed circuit board being mounted in said at least one longitudinal printed circuit board mounting slot, each clip comprising a flat mounting portion inserted into either clip mounting hole and retained between either mounting post and the angle plate of the respective locating post, a handle portion at the top, a curved spring portion connected between said flat mounting portion and said handle portion, a unitary stop arm extended forwards from one lateral side of said curved spring portion and stopped at one side of the printed circuit board in said at least one printed circuit board mounting slot, said stop arm giving a pressure to either of said at least one printed circuit board in direction against the horizontal extension rod of the respective locating post, two opposite pointed projections bilaterally extended from two opposite lateral sides of said flat mounting portion and hooked in either clip mounting hole, a hook raised from a front surface of said flat mounting portion and disposed between said pointed projections and hooked on either angle plate at the bottom, and two backward clamping arms bilaterally extended backwards from the two opposite lateral sides of said flat mounting portion at right angles and spaced above said pointed projections and clamped on two opposite sides of either mounting post.

* * * * *